US005544952A

United States Patent [19]

Schneider

[11] Patent Number: 5,544,952

[45] Date of Patent: Aug. 13, 1996

[54] SPIRAL VORTEX DEVICE

[76] Inventor: Siegfried Schneider, Georg-Groening-Strasse 88, 28209 Bremen, Germany

[21] Appl. No.: 324,573

[22] Filed: Oct. 18, 1994

[30] Foreign Application Priority Data

Oct. 18, 1993 [DE] Germany ..... P 43 35 483.1

[51] Int. Cl.[6] ..... B01F 5/12; B01F 7/16; B01F 9/10; F15D 1/10

[52] U.S. Cl. ..... 366/175.1; 366/174.1; 366/231; 366/262; 366/305

[58] Field of Search ..... 366/53, 54, 56, 366/135, 165.1, 165.2, 165.4, 175.1, 175.3, 182.4, 192, 219, 220, 225, 230, 231, 235, 262–265, 169.1, 174.1, 302, 305

[56] References Cited

U.S. PATENT DOCUMENTS

| | | | |
|---|---|---|---|
| 444,345 | 1/1891 | Gabbett | 366/265 |
| 2,390,579 | 12/1945 | Fritzberg | 366/263 X |
| 2,655,436 | 10/1953 | Bishop et al. | 366/265 X |
| 5,292,194 | 3/1994 | Gabor | 366/262 X |
| 5,393,502 | 2/1995 | Miller et al. | 366/165.1 X |

FOREIGN PATENT DOCUMENTS

| | | | |
|---|---|---|---|
| 1450848 | 1/1989 | U.S.S.R. | 366/263 |
| 1377630 | 12/1974 | United Kingdom | 366/263 |

*Primary Examiner*—Charles E. Cooley
*Attorney, Agent, or Firm*—Dominik & Stein

[57] ABSTRACT

Spiral vortex device for the determined production of spiral flows in a liquid, especially in water provided with a rotation-symmetrical external container, a rotation-symmetrical internal container having two open ends, a drive shaft and a deflection piece, whereby by the driveshaft a relative rotation between the external container and the internal container is executable in such a manner that between the external and internal container an ascending, spiral flow is produced which through interaction with the deflection piece is reversed in its direction and then descends spirally inside of the internal container turning in the opposite direction.

25 Claims, 3 Drawing Sheets

SPIRAL VORTEX DEVICE

BACKGROUND OF THE INVENTION

1. Field of the Invention

The invention concerns a spiral vortex device for the determined creation of spiral shaped flows in liquids, especially water, with a rotation symmetrical external container, a rotation symmetrical internal container which has two open ends, a driveshaft and a deflection piece.

2. Description of the Related Art

Conventional mixing- and/or stirring devices aim, for instance, at a thorough mixture of a liquid, which either a gas, another liquid or a solid substance is to be mixed with, without the necessity of a special structuring of the mixing process.

The document U.S. Pat. No. 4,009,005, for instance, describes a mixing device which creates by means of a propeller a vortex showing flow, i.e. a quickly whirling, turbulent flow. And the document DT 1801626 C3 describes a mixing device in which by means of a running wheel two essentially opposing flows can be created through the dimensioning of the mixing device, which for turbulences creating intensive mixing come into contact along a sufficiently long measured distance.

With the conventional mixing devices an increase of the interaction of at least one solid, liquid or gaslike substance with water by creation and stabilization of a colloidal condition however cannot be satisfactorily achieved.

A colloidal condition which is essentially characterized by a large surface between water and the therein dispersed substance and so by physical as well as chemical boundary layer phenomenons can be satisfactorily created and also be stabilized when the water, which may have for reasons of its inherent hydrogen combinations a magnitude of quasi "grid-structures", is impressed a certain structure in order to enable a new texture formation with the incorporated substances. Such a structure impression can only be achieved with a device which assures an exactly specified production of spiral vortex flows.

A before mentioned spiral vortex device of the common kind as described, for instance, in the documents EP 0 134 890 B1 or DE 3738223 A1, serves to the desired change of the structural compound of the water structure. Thereby water is being brought into the external container. An accelerator situated inside of the external container and underneath of the lower opening of the internal container is turned by a driveshaft and cresses a centripetal force and an underpressure, causing a suction effect. By the suction effect water is driven into a precisely defined flow line so that the water moves upward in a spiral manner into the interspace between the external and the internal container until it is reflected at the deflection piece whereby the deflection piece is formed in a manner that the water flows in an opposite direction spirally from top to bottom through the internal container. The flow velocity of the water increases steadily because the spiral vortices created under the influence of gravity and in dependency of the chosen form of the external and internal containers receive additional forces because of the underpressure caused by the mechanical stirring inside the internal container. Thereby in the course of the spiral line steadily decreasing flow layers are formed while two adjacent flow layers have different flow velocities. Caused by the so existing velocity gradient turbulence nuclei are created in the contact zone of the flow layers so that there microvortices are torn off and are embedded into the water. By this manner the water structure is "loosened up", so to speak, so that the ever present gravity may partially be compensated by the pressure gradient inherent in each microvortex.

A similar "loosening-up" of the water is caused in nature, for instance, in rivers by curves, meanders, diminuation of the river bed, sudden sloping or the like, especially in rapids. However none of the known devices which are equipped with driven propellers, whirlpaddles, pendulumdiscs or the like are capable to naturally recreate the vortex creation of the water in the nature inherent flow shapes and simultaneously enable an exact tuning of the flow.

The task of the invention is to provide a .special vortex device of the before mentioned kind which can conquer the above mentioned disadvantages and enable the determined creation of reality like spiral vortices. Also the energy consumption should be minimized and the created colloidal condition optimized.

SUMMARY OF THE INVENTION

For the solution of this task the spiral vortex device according to the invention is characterized as follows: with the help of the drive shaft a relative turning between the external and internal container can be achieved so that between the external and internal container an ascending spiral flow is created which by interaction with the deflection piece is reversed in its direction and then descends spirally inside of the internal container turning in an opposite direction.

It may be designed that the external container is mainly in an ellipsoid shape.

Moreover the invention proposes that the internal container is mainly shaped like a funnel and can be of a hyperbolic design.

According to the invention it is likewise proposed that the area of the internal container With the smallest diameter is situated in the area of the external container with the smallest diameter, whereby, in operation, said areas with the smallest diameters are located at the lower end of the spiral vortex device and the longitudinal axis of the external container coincides with the longitudinal axis of the internal container.

It is preferred that the deflection piece in the upper area of the external container is located above of the upper opening of the internal container in the form of deflection sheets.

The invention likewise proposes that the cross section of a deflection sheet is arc shaped.

Further it could be intended that continuously treatable liquid is to be fed through a feeder pipe and already treated liquid is to be discharged through an outflow pipe.

According to the invention it is thereby preferred that the inflow of water is adjustable by means of a first valve in the feeder pipe and/or the outflow of the water by means of a second valve in the outflow pipe.

Furthermore it is proposed according to the invention that the external container does 1 to 1,500 revolutions per minute relative to the internal container.

One design form of the invention is thereby characterized in that the external container is solidly connected to the drive shaft while the internal container is fixed in its idle position by a bracket.

Thereby it is proposed that the feeder pipe as well as the outflow pipe reach the turnable external container through a tight connection.

Furthermore the invention proposes that the bracket embraces the feeder pipe.

It can also be intended that the deflection sheets are to be fastened to the brackets.

Further the invention proposes that the feeder pipe is designed concentrically to the axis of rotation of the external container and that it is connected to radial rods which are fixed to the inside of the internal container.

Also it is thereby proposed that the rods are to be stabilized by a ring to which the deflection sheets are fixed.

Another design form according to the invention is characterized in that the internal container is connected solidly with the drive shaft whereas the external container is fixed.

Thereby it is proposed according to the invention that the feeder pipe as well as the outflow pipe are solidly connected with the external container.

Also the invention proposes that the deflection sheets are solidly connected to the external container.

According to the invention it can be foreseen that the drive shaft runs parallel and/or concentrical to the feeder pipe.

Further the invention proposes that the drive shaft is connected to the internal container at the small end of its funnel whereas openings are provided between the drive shaft and the internal container.

Furthermore it can be foreseen that the feeder pipe and the outflow pipe are fixed at the same end or at opposite ends of the spiral vortex devices.

The invention further proposes that the drive shaft is connected with a V-belt, a hand crank, a motor or similar device.

Also it is proposed that the external container is placed in a protection cover.

Furthermore it is preferred that the external container and/or the internal container consist of a transparent material like glass.

Finally it can also be foreseen that the external and/or the internal container consist of clay, ceramics and/or china.

The invention is based on the surprising discovery that by turning of the external container while the internal container rests immobile or vice versa, water gets into a similar situation as when streaming down a meandering riverbed while all measurements of a spiral vortex device according to the invention can be chosen in such a manner as to produce microvortices in the water and to have them therein embedded.

BRIEF DESCRIPTION OF THE DRAWINGS

Additional characteristics and advantages of the invention yield the following description, in which two design forms of the invention are explained in particular according to schematic drawings. It shows.

DETAILED DESCRIPTION OF THE INVENTION

Figure 1:
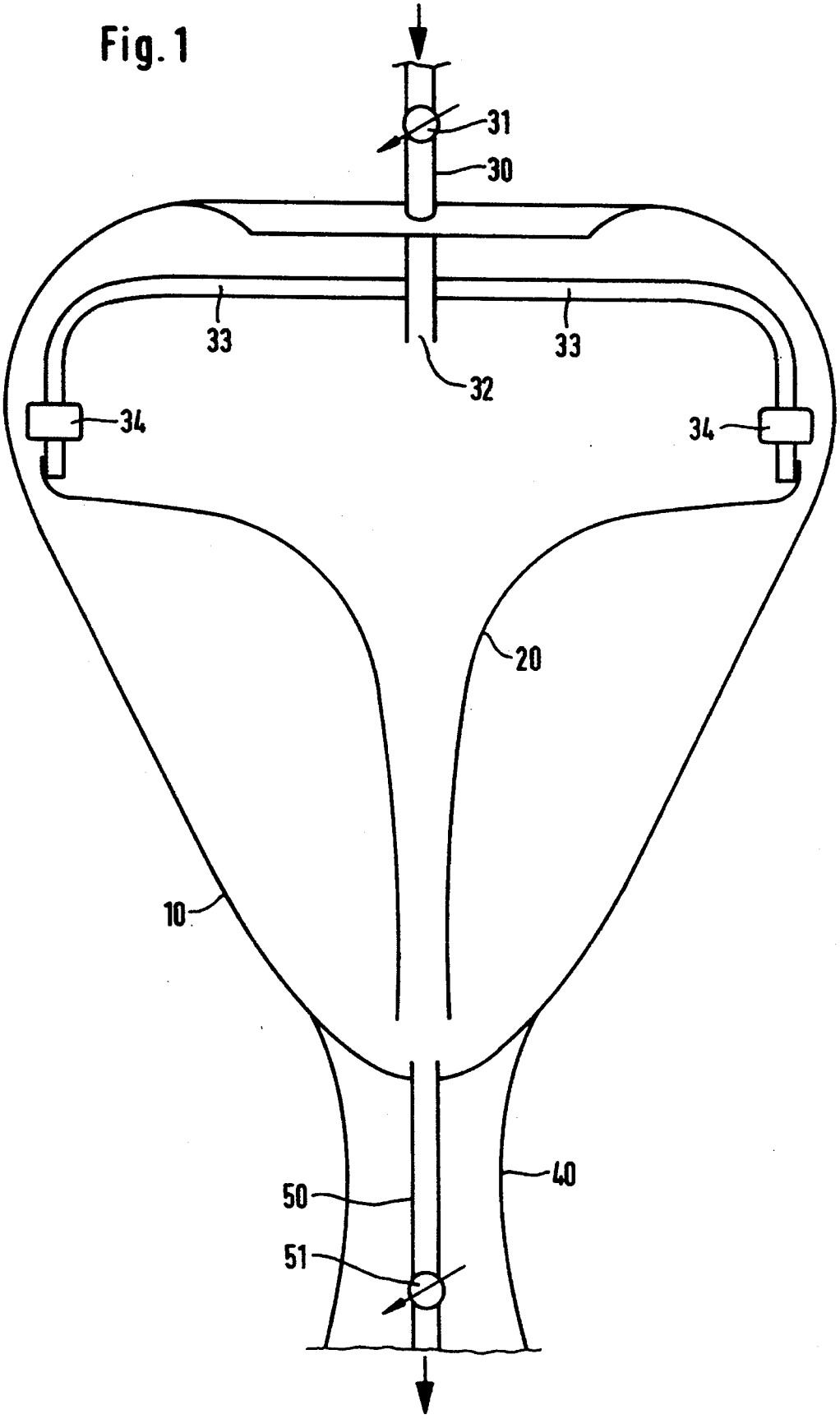
FIG. 1 a longitudinal section of a design form of a spiral vortex device according to the invention with a rotating external container FIG. 2 a top view of the bracket of the internal container of the spiral vortex device from FIG. 1, and FIG. 3 a longitudinal section of a design form of a spiral vortex device according to the invention with a rotating internal container.
Figure 2:
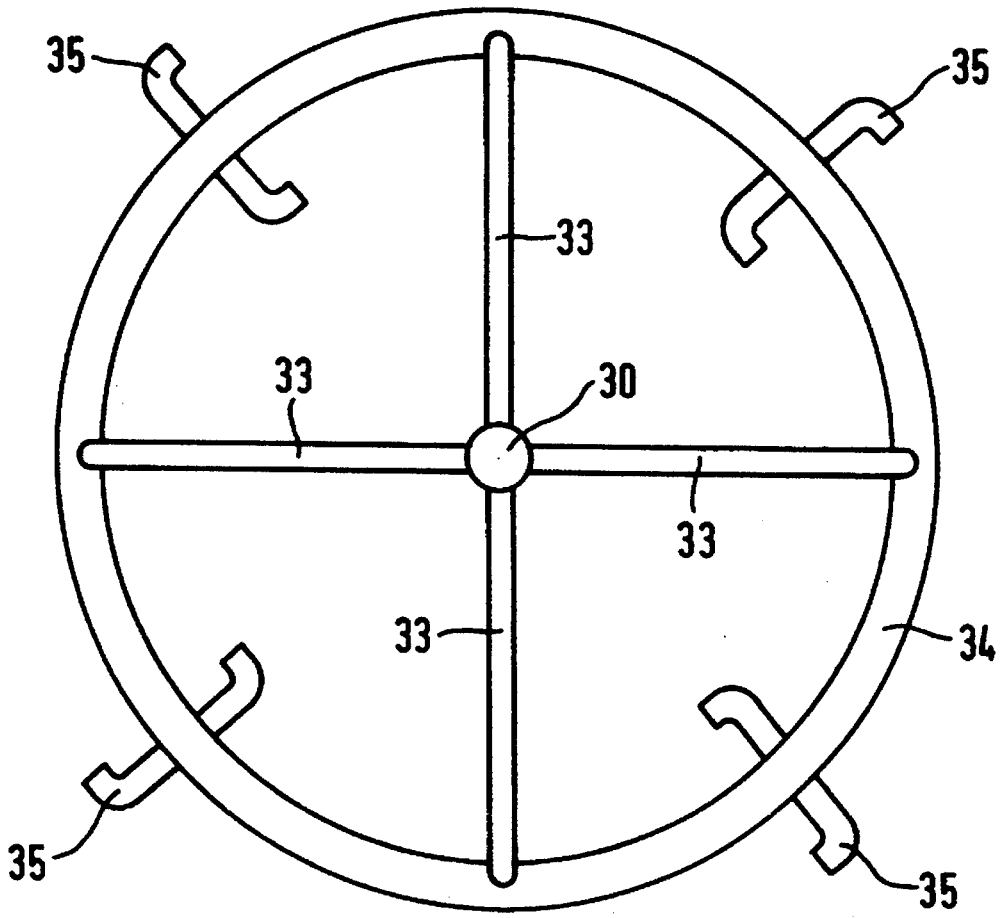

FIG. 1 and 2 show the principal composition of a design form of a spiral vortex device according to the invention in which a mainly ellipsoid formed external container which fosters a soft vortex formation, turns around a concentrical internal container 20 which has a hyperbolic funnel configuration (and which is located in the external container). Thereby the smaller funnel end of the internal container 20 is placed in the lower area of the external container 10, which has a smaller diameter than the upper area of the external container 10.

A feeder pipe 30 with a valve 31 is connected outside the external container 10 with a not shown bracket and intrudes stationary fitted through a not shown sliding seal into the turnable external container 10, so theft through an opening 32 water can be filled into the spiral vortex device. With the pipe 30 are connected, for instance, as shown in FIG. 2, four mainly radial rods 33, which are attached equidistantly inside to the internal container 20 in order to fix it. The four rods 33 which push against the internal container 20 are being stabilized by means of a ring 34 which is placed concentrically to the pipe 30 and mainly above the funnel opening of the internal container 20 with large diameter. On the ring 34 are also attached, for instance, four equidistant deflection sheets 35, which show in the top view an arc shape, as shown in FIG. 2.

The external container 10 is connected at its lower end with a drive shaft 40, which may be driven by a not shown motor in order to turn the external container 10 preferably approximately 300 to 400 revolutions per minute around the internal container 20.

Through a not shown sliding seal an outflow pipe 50 with valve 51 intrudes from underneath into the turnable external container 10, while the outflow pipe 50 itself is fixed by a not shown bracket. Thereby the outflow pipe 50 as well as the feeder pipe 30 are positioned concentrically to the rotation axis of the external container 10.

Figure 3:
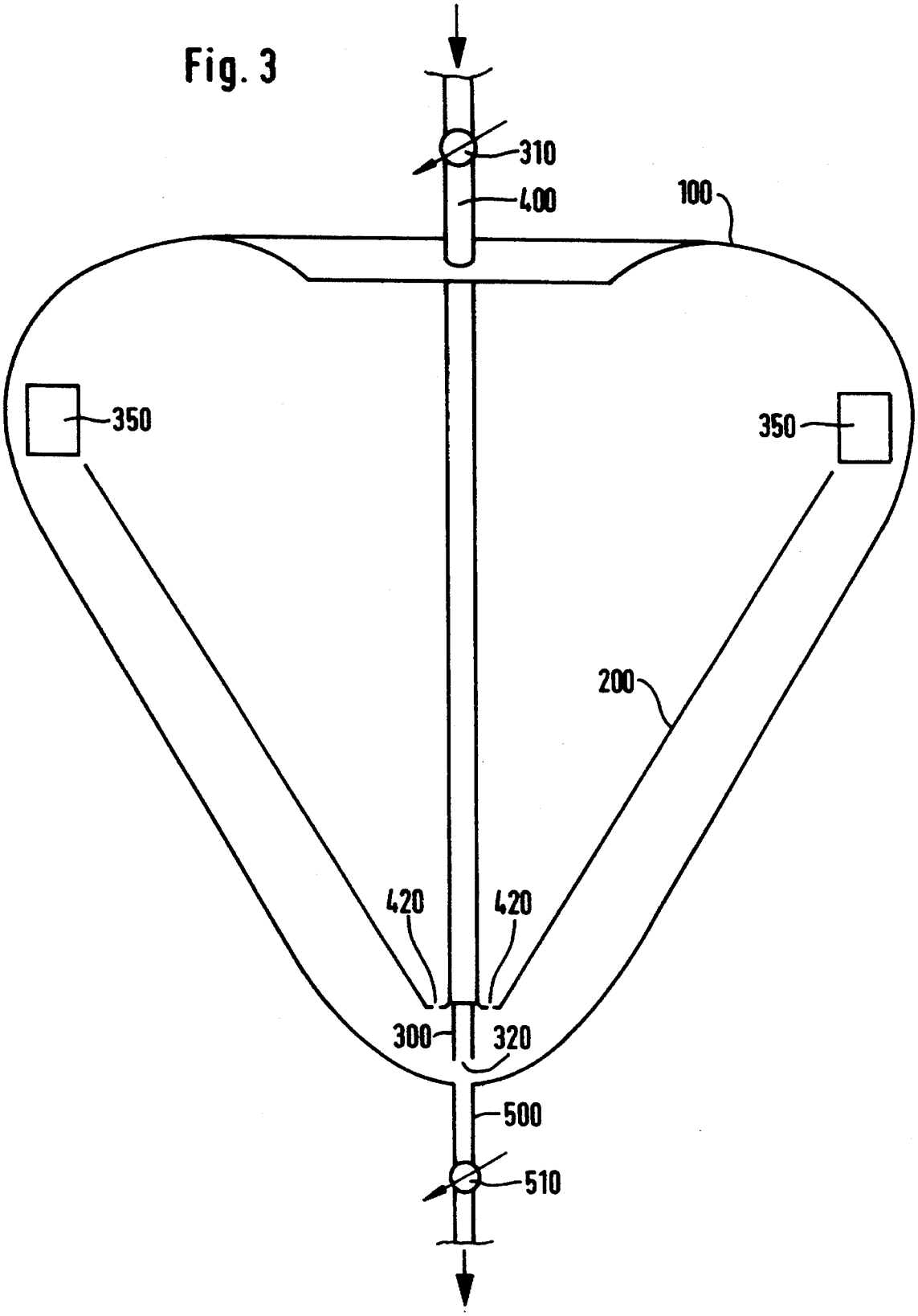

FIG. 3 shows as an alternative to the design form as shown in FIGS. 1 and 2 a spiral vortex device according to the invention in which an external container 100 is fixed stationary while a funnel shaped internal container 200 concentrically placed inside the external container 100, is turnable. Thereby the external container 100 shows again a mainly ellipsoid shape which fosters a soft vortexlike movement of the water stored in the external container 100 of which the part with the smaller diameter is placed downwards whereby the funnel end of the internal container 200 with the smaller diameter is arranged also in the lower area of the spiral vortex device.

A feeder pipe 300 is placed concentrically to the turning axis of the internal container 200 which is fixed outside of the external container 100 by means of a not shown bracket and which contains a valve 310. The feeder pipe 300 intrudes into the external container 100, almost traversing it and shows in the lower area of the spiral vortex device an opening 320 through which water is fillable into the external container 100.

In the upper part of the spiral vortex device deflection sheets 350 are placed close above the funnel opening of the internal container 200 mainly between the external container 100 and the internal container 200, of which only two are shown in FIG. 3. Moreover the deflection sheets 350 are tightly connected to the external container 100.

Concentrical with the feeder pipe 300 a driveshaft 400 is placed which is connected by means of a not shown first sliding seal with the idle external container 100 and by means of a not shown second sliding seal with the idle feeder pipe 300. The drive shaft 400 can be connected on one end with a not shown motor and is connected on the other end with the smaller diameter showing part of the internal container 200, which the drive shaft turns preferably 300 to 400 revolutions per minute around its longitudinal axis. Alongside the circumference of the connection between the driveshaft 400 and the internal container 200 openings 420 are foreseen, of which two are shown in FIG. 3. Through these openings water can flow from the funnel of the internal container 200 into the interspace between the external container 100 and the internal container 200.

An outflow pipe 500 with a valve 510 is tightly fixed with the lower end of the external container 100 and placed concentrically to the rotation axis of the internal container 200.

The before mentioned spiral vortex devices according to the invention work as follows:

At the initial filling of the external container 10 or 100 with water to be treated, not yet treated water will be fed to the spiral vortex device through the feeder pipe 30 or 300 as symbolized by an arrow in FIGS. 1 and 3.

If so desired water could also be filled into the external container 10 or 100 via valve 31 or 310 in a controlled and continuous manner, wherein the controlling of the valves 31 or 310 is dependent upon the flow rate through the respective spiral vortex device.

During the operation a relative rotation happens between the external container 10 or 100 and the internal container 20 or 200. With the design form according the FIGS. 1 and 2 the external container 10 is rotating by means of the drive shaft 40 around the fixed internal container 20. With the design form according to FIG. 3, the internal container 200 turns by means of the drive shaft 400 inside the idle external container 100.

Gravitational and friction forces which are created by the relative movement between the external container 10 or 100 and the internal container 20 or 200, provide that the water which is stored in the lower area of the external container 10 or 100 is moving upward spirally in the interspace between the internal container 20 or 200 and the external container 10 or 100. As soon as the upward flow which is rather homogeneous due to the geometry of the two containers 10 or 100, 20 or 200 comes into interaction with the deflection sheets 35 or 350, the flow direction is reversed without causing additional turbulences in the water so that a downward spiral flow is produced with an opposite sense of rotation in the internal container 20 or 200 with continuously increasing flow velocity.

The reversing of direction as described above and mainly caused by an arclike shape of the deflection sheets 35 or 350 only takes place without the creation of additional undesired turbulences if the geometry of the spiral vortex device, be it the design form according to FIGS. 1 and 2 or according to FIG. 3, the rotation velocity of the external container 10 or 100 relative to the internal container 20 or 200 as well as the water inflow and the water outflow are exactly tuned to each other.

Due to the velocity gradient inherent in the spiral flow micro vortices are created as already described which "loosen-up" the water structure, so that the treated water, for instance, can better absorb other substances partially countering the gravity. By means of the outflow pipe 50 or 500 the so threated water can finally be taken out whereas the valve 51 or 510 enables an exact withdrawal.

For the exact control of the flow rate of the water the valves 31 or 310, 51 or 510 in the feeder pipe 30 or 300 as well as in the outflow pipe 50 or 500 can be regulated by a not shown microprocessor. For this purpose it is particularly advantageous when the valves 31 or 310, 51 or 510 are solenoid valves. Of course, also the drive shaft 40 or 400 can be controlled by means of a microprocessor.

The microstructure impressed to the water, that is in form of embedded microvortices, depends on the respective vortex structure which depends on the dimensioning and placement of the individual components, especially the external container 10 or 100, the internal container 20 or 200 and the deflection sheets 35 or 350, number of revolutions of the relative movement between the two containers 10 or 100, 20 or 200, as well, eventually the flow rate.

By not using a drivable device as a propeller, a whirl paddle or a pendulumdisc for the production of the required vortex structure but instead by using the rotation of the complete external container 10 respectively the internal container 200 and without creating mainly over the complete hight a velocity gradient, a more natural spiral vortex formation is achieved than with the already known devices. Furthermore a spiral vortex device according to the invention creates a most homogeneous flow and even enables a continuous operation during which it must not be refilled, operated and drained but instead water can continuously flow in and out.

The characteristics of the invention as described above as well as in the drawings and claims can be essential for the realisation of the invention in its various forms of design either individually or in any combination.

What is claimed is:

1. Spiral vortex device for the determined production of spiral flows in a liquid, said device comprising:

a rotation-symmetrical external container, a rotation-symmetrical internal container arranged centrally within the external container and having an upper open end and a lower open end and defining a liquid flow space between said internal and external container, a drive shaft, and at least one fixed deflection piece being arranged in the upper part of the external container above the upper open end of the internal container, wherein the driveshaft (40, 400) either drives the external container (10, 100), the internal container (20, 200) being fixed, or drives the internal container (20, 200), the external container (10, 100) being fixed, and wherein, in the case the external container (10, 100) is driven, an ascending spiral flow of liquid rotating in a first direction is generated between the external container (10, 100) and the internal container (20, 200), which liquid flow is inverted upon interaction with the deflection piece (35, 350), wherein said liquid flow then descends in the form of a spiral flow rotating in the opposite direction to the direction of rotation of the ascending flow, and in the case the internal container (20, 200) is driven, the ascending and descending flows are directed in opposite directions to those in the case that the external container is driven.

2. Spiral vortex device according to claim 1, wherein the external container (10, 100) is mainly ellipsoid.

3. Spiral vortex according to claim 2, wherein the internal container has a part having a broader diameter and a part having a narrower diameter, wherein the external container has a part having a broader diameter and a part having a narrower diameter, and wherein said part of the internal container (20, 200) with the narrowest diameter is situated in said part of the external container (10, 100) with the narrowest diameter, whereby in operation said parts with the narrowest diameters are placed at the bottom end of the spiral vortex device and the longitudinal axis of the external container (10, 100) coincides with the longitudinal axis of the internal container (20, 200).

4. Spiral vortex device according to claim 2, wherein the internal container (200) is hyperbolic shaped.

5. Spiral vortex device according to claim 1, wherein the internal container (20, 200) is mainly funnel shaped.

6. Spiral vortex device according to claim 1, wherein the cross section of the at least one deflection piece (35, 350) is arc shaped.

7. Spiral vortex device according to claim 1, further comprising a feeder pipe (30, 300) in communication with one of either the interior space of the internal container or the space between the internal and external containers, through which feeder pipe treatable liquid can be continuously fed and an outflow pipe (50, 500) in communication with the other of either the interior space of the internal container or the space between the internal and external containers, through which treated liquid can be taken out.

8. Spiral vortex device according to claim 7, further comprising a valve (31, 310) in the feeder pipe for controlling the filling of the vortex device with the liquid.

9. Spiral vortex device according to claim 7, wherein the internal container (200) is tightly connected with the drive shaft (400) while the external container (100) is in a fixed position.

10. Spiral vortex device according to claim 9, wherein the feeder pipe (300) as well as the outflow pipe (500) are tightly connected with the external container (100).

11. Spiral vortex device according to claim 9, wherein said at least one deflection piece (350) is tightly connected with the external container (100).

12. Spiral vortex device according to claim 9, wherein the drive shaft (400) runs one of parallel or concentrical to the feeder pipe (300).

13. Spiral vortex device according to claim 9, wherein the internal container has a part having a broader diameter, and a part having a narrower diameter, the external container has a part having a broader diameter and a part having a narrower diameter, and said drive shaft (400) is connected with the internal container (200) at the narrower part thereof and whereby openings (420) are provided in an interface between the drive shaft (400) and the internal container (200).

14. Spiral vortex device according to claim 7, further comprising a valve (51, 50) in the outflow pipe (50, 500) for controlling the outflow of liquid from the vortex device.

15. Spiral vortex device according to claim 1, wherein the external container (10, 100) is provided with drive means for turning the external container (10, 100) at 1 to 1,500 revolutions per minute relative to the internal container (20, 200).

16. Spiral vortex device according to claim 1, further comprising a feeder pipe (30, 300) in communication with one of either the interior space of the internal container or the space between the internal and external containers, through which feeder pipe treatable liquid can be continuously fed and an outflow pipe (59, 500) in communication with the other of either the interior space of the internal container or the space between the internal and external containers, through which treated liquid can be taken out, wherein the external container (10) is connected tightly with the drive shaft (40) for driving the external container about a rotation axis which is coaxial with the internal container, while the internal container (20) is fixed in an idle position with a bracket (30, 33, 34).

17. Spiral vortex device according to claim 16, wherein the feeder pipe (30) as well as the outflow pipe (50) extend through the rotating external container (10) via a liquid tight connection.

18. Spiral vortex device according to claim 16, wherein said bracket (30, 33, 34) encompasses said feeder pipe (30).

19. Spiral vortex device according to claim 18, wherein said bracket comprises radial rods, said feeder pipe (30) is positioned concentrically to the rotation axis of the external container (10) and is connected to said radial rods (33) which are fixed to the inside of the internal container (20).

20. Spiral vortex device according to claim 19, wherein said bracket further comprises a ring said rods (33) are connected to and structurally stabilized by said ring (34) to which the at least one deflection piece (33) is attached.

21. Spiral vortex device according to claim 15, wherein said at least one deflection piece (35) is attached to the bracket (30, 33, 34).

22. Spiral vortex device according to claim 1, further comprising a feeder pipe (30, 300) in communication with one of either the interior space of the internal container or the space between the internal and external containers, through which feeder pipe treatable liquid can be continuously fed and an outflow pipe (50, 500) in communication with the other of either the interior space of the internal container or the space between the internal and external containers, through which treated liquid can be taken out, and wherein the feeder pipe (30, 300) and the outflow pipe (50, 500) are attached at opposite ends of the spiral vortex device.

23. Spiral vortex device according to claim 1, wherein at least one of the external container (10, 100) and the internal container (20, 200) consist of a transparent material.

24. Spiral vortex device according claim 1, wherein at least one of the external container (10, 100) and the internal container (20, 200) consist of a material selected from the group consisting of clay, ceramics and china.

25. Spiral vortex device according to claim 1, further comprising a feeder pipe (30, 300) in communication with one of either the interior space of the internal container or the space between the internal and external containers, through which feeder pipe treatable liquid can be continuously fed and an outflow pipe (50, 500) in communication with the other of either the interior space of the internal container or the space between the internal and external containers, through which treated liquid can be taken out, wherein the feeder pipe (30, 300) and tile outflow pipe (50, 500) are attached at the same end of the spiral vortex device.

* * * * *